US005742946A

United States Patent [19]

Garofalo

[11] Patent Number: 5,742,946

[45] Date of Patent: Apr. 28, 1998

[54] DIVING MASK

[75] Inventor: Giovanni Garofalo, Rapallo, Italy

[73] Assignee: HTM Sport S.p.A., Italy

[21] Appl. No.: 709,299

[22] Filed: Sep. 9, 1996

[30] Foreign Application Priority Data

Sep. 27, 1995 [IT] Italy ..... GE95A0104

[51] Int. Cl.[6] ..... A61F 9/02

[52] U.S. Cl. ..... 2/428; 2/452

[58] Field of Search ..... 2/428, 429, 430, 2/452, 426; 128/206.23, 206.24, 201.27

[56] References Cited

U.S. PATENT DOCUMENTS 1,935,634 11/1933 Ives .
3,483,569 12/1969 Armendariz ..... 2/430
4,077,068 3/1978 Anderson ..... 2/428
4,171,543 10/1979 Cressi .
4,286,340 9/1981 Lathrop ..... 2/452
5,329,643 7/1994 Sato .
5,347,615 9/1994 Garofalo ..... 2/430

*Primary Examiner*—Peter Nerbun
*Attorney, Agent, or Firm*—Larson & Taylor

[57] ABSTRACT

A diving mask includes a frame with a monocular or binocular lens, fasteners for a strap located on the sides of the said frame, and a structure made of elastomeric material, located between the frame and the lens and constituting the body element of the mask. The top edges of the fasteners are located close to or aligned with the top edge of the frame so that the bottom edge of the mask lifts up and the top part of the mask remains firmly in contact with the diver's face as a result of air being blown through the diver's nose. No other strap is secured to the frame.

3 Claims, 1 Drawing Sheet

DIVING MASK

FIELD OF THE INVENTION

The present invention relates to a diving mask.

More specifically, the present invention relates to a diving mask which enables the operation known in diving jargon as mask-emptying to be carried out without the diver having to hold the top part of the said mask against his forehead with his hands.

BACKGROUND OF THE INVENTION

It is a known fact that, when diving at depth, divers need to empty their masks of water if, for whatever reason, they have had to remove their masks from their faces. A diver must replace the mask on his face as quickly as possible and empty the water from it in order to restore visibility to a satisfactory degree. Under these conditions, the mask-emptying operation is normally carried out by the diver blowing air through his nose and into the mask, while at the same time using his hand to hold the top part of the mask in sealing contact with his forehead and pulling the bottom part slightly away from his cheekbones. In this way, the air blown in via the nose will force the water out of the mask via the bottom of the latter, so that it will eventually contain only air. At this stage all the diver then needs to do is release the mask so that the mask strap will hold the mask against his face in the usual way, thereby providing sealing contact all the way around its edge.

As mentioned previously, the operation sometimes needs to be carried out in emergency situations or in any case in awkward situations at depth. If the diver is sufficiently dexterous, emptying out conventional masks can be done using only one hand, but often most divers need to use both hands. This frequently means that both hands have to be free of any objects or equipment in general and, in the case of an emergency, both hands need to be able to work quickly and efficiently.

SUMMARY OF THE INVENTION

The object of the present invention is to overcome the abovementioned disadvantages.

More specifically, the present invention relates to a diving mask that enables the operation known in diving jargon as mask-emptying to be carried out without the diver having to hold the top part of the mask against his forehead.

Another object of the present invention is to provide a diving mask that is guaranteed to be remarkably strong and reliable over time and one that is easy and cheap to produce.

These and other objects which will be detailed below are achieved by the diving mask according to the invention which comprises a frame with a monocular or binocular lens, fasteners for a strap located on the sides of the frame, and a structure made of elastomeric material, located between the frame and the lens and constituting the body element of the mask, characterized in that the fasteners are shifted eccentrically upwards with respect to the frame, their top edges being close to or aligned with the top edge of the frame.

BRIEF DESCRIPTION OF THE DRAWINGS

These and other features of the diving mask will be more clearly explained in the following detailed description, which is given with reference to the figures in the appended sheet of drawings which represent a nonlimiting example of an embodiment of the invention and in which.

DESCRIPTION OF THE PREFERRED EMBODIMENT

Figure 1:
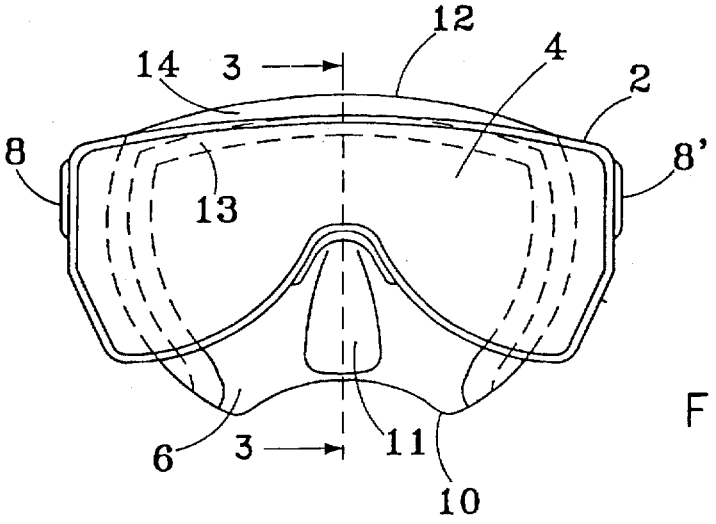
FIG. 1 is a diagrammatic front view of the diving mask according to the present invention.
Figure 2:
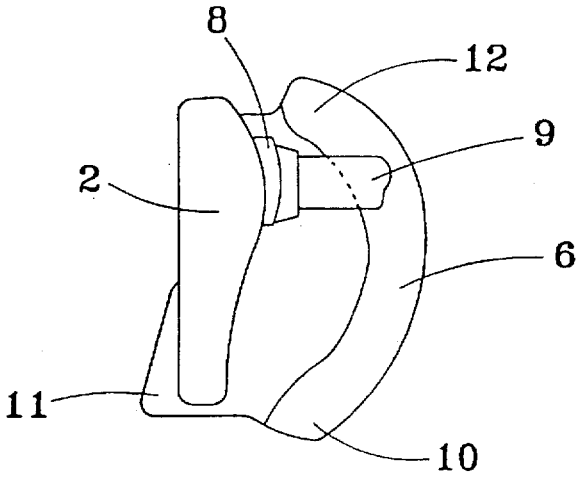
FIG. 2 is a diagrammatic side view of the diving mask according to the present invention.

With reference to the aforesaid figures, the diving mask, which is indicated as a whole by the reference numeral 1, consists of a frame 2 provided with fastening teeth for a lens 4. Between the said frame 2 and the lens, and all the way around the latter, there is a sealing edge of elastomeric material that extends from one side of the lens to form the body element 6 of the mask which rests against the diver's face.

The said element 6 basically consists of a ring, the bottom part 10 of which conventionally comprises a nasal cavity 11 into which the diver's nose fits, and, to either side of the said cavity 11, of an edge shaped so that it fits around the cheekbones of the diver's face. The top part 12 of the ring constitutes the edge that rests against the forehead and the temples, and then continues downwards to join the aforesaid cheekbone edge.

Figure 3:
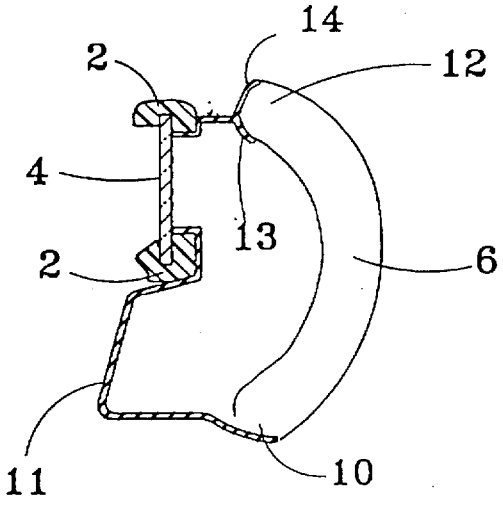
FIG. 3 is a diagrammatic view, in cross-section along the line 3—3 in FIG. 1, of the diving mask according to the present invention.

According to the present invention, the top edge 12, as seen more clearly in the cross-section shown in FIG. 3, has a top fin 13 and a bottom fin 14 which open out vertically and perpendicularly to the edge and are approximately of the same width. The shape of the said top edge 12 extends over the whole of the front region and over part of the temporal region, at which point the bottom or inner fin 14 is gradually adapted in terms of width until it gradually thins down to nothing as it continues downwards.

In addition, conventional fasteners 8, 8' for the strap 9 are located en either side of the frame 2, on that part thereof which corresponds to the temples. According to a further feature of the present invention, the said fasteners 8, 8' are located at the end of the aforesaid vertical temporal region, close to the top corners on the top edge of the frame, between the said temporal regions and the horizontal front region. Alternatively, the fastener may be aligned with the top edge of the frame.

The way in which the diving mask that forms the subject of the present invention works should be evident from the preceding detailed structural description. Thus, as already mentioned previously, emptying the mask at depth is performed by the diver pulling the bottom part of the mask away from his face and manually holding the top part thereof so that it always remains in contact with his face. The mask that forms the subject of the present invention is shaped so that, by blowing air into it through the nose, only the bottom part of the rubber edge that rests against the diver's face, that is the cheekbone part, lifts up automatically, whereas the top part, that is the front region, remains firmly in contact with the diver's face.

This feature is due to the characteristics of the top edge 12 and to the position of the fasteners 8, 8' for the strap 9. The latter are located so that they cause the mask to press with greater pressure against the forehead and with lesser pressure against the cheekbones. This basically gives rise to a lever type effect, with the fulcrum of this lever being located on the top edge 12 of the rubber structure. When the diver blows air into the mask through his nose, this lever action is brought into play, thereby allowing the water present in the mask to flow out via the bottom, that is down over the cheekbones, thus emptying the mask correctly. The top edge 12 referred to above possesses the two above-mentioned fins 13, 14 which enable the said part to act as a fulcrum, facilitating the upward rotation of the mask, while at the same time holding it firmly against the diver's forehead so as to prevent the entry of water.

The preceding structural and functional description of the diving mask that forms the subject of the present invention serves to further highlight the advantages already referred to above. Thus, emptying the mask is made easier since, given that this operation is usually performed at depth, the fact that the diver no longer needs to use his hands to empty his mask is extremely important from the point of view of safety as well as convenience. This is because a fully kitted out diver very often carries a considerable amount of equipment which he may have to let go of temporarily whenever he needs to empty his mask, with the consequent possibility that he may lose it in the open sea.

What I claim is:

1. A diving mask comprising:

a body element made of elastomeric rubber-like material forming the face piece of the mask, said face piece including a front opening and a peripheral rim adhering against the face of the user;

a frame having a top edge secured in a water-tight manner to said front opening of said face piece;

at least one lens secured in a water-tight manner to said frame; and a pair of fasteners for securing a strap to said frame, each of said fasteners having a top edge located at the sides of said frame, the top edges of said fasteners being close to, or aligned with the top edge of said frame so that the bottom edge of the mask lifts up and the top part of the mask remains firmly in contact with a diver's face as a result of air being blown through the diver's nose, and wherein no other strap is secured to said frame.

2. The diving mask according to claim 1, wherein the peripheral rim of the face piece includes a top fin and a bottom fin which open out vertically and perpendicularly to said top edge of said frame and extend over an entire length of the top edge of said frame.

3. The diving mask according to claim 2, wherein the bottom fin gradually decreases in width as the bottom fin approaches the bottom edge of the body element.

* * * * *